US005201636A

United States Patent [19]

Mikulski

[11] Patent Number: 5,201,636

[45] Date of Patent: Apr. 13, 1993

[54] STATOR CURRENT BASED MALFUNCTION DETECTING SYSTEM IN A VARIABLE FLOW DELIVERY PUMP

[75] Inventor: Henry Mikulski, Churchville, Pa.

[73] Assignee: Milton Roy Company, St. Petersburg, Fla.

[21] Appl. No.: 657,528

[22] Filed: Feb. 19, 1991

[51] Int. Cl.[5] ..... F04B 49/06

[52] U.S. Cl. ..... 417/18; 417/22; 417/53

[58] Field of Search ..... 417/18, 53, 22

[56] References Cited

U.S. PATENT DOCUMENTS

| | | | |
|---|---|---|---|
| 4,180,375 | 12/1979 | Magnussen, Jr. . | |
| 4,225,290 | 9/1980 | Allington . | |
| 4,375,346 | 3/1983 | Kraus et al. | 417/395 |
| 4,509,901 | 4/1985 | McTamaney et al. | 417/18 |
| 4,617,637 | 10/1986 | Chu et al. | 417/18 |
| 5,074,755 | 12/1991 | Vincent | 417/18 |

FOREIGN PATENT DOCUMENTS

| | | | |
|---|---|---|---|
| 8911302 | 11/1989 | World Int. Prop. O. | 417/474 |

OTHER PUBLICATIONS

Instruction Manual, Milton Roy Flow Control, "High Performance Diaphragm Liquid End [HPD]-Milroyal B, C and D", 60.3.

Instruction Manual, Milton Roy Flow Control, "max-ROY B", 118.7.

*Primary Examiner*—Richard A. Bertsch

*Assistant Examiner*—David W. Scheuermann

*Attorney, Agent, or Firm*—Woodcock Washburn Kurtz Mackiewicz & Norris

[57] ABSTRACT

The current invention detects malfunctions in a variable flow delivery pump. These malfunctions prevent the pump from sustaining inherently high accuracy and/or cause damages to the pump. The invention detects the malfunctions without comparing sampled values to a preset absolute value. A malfunction is determined by a pattern of force exerted on a displacement pump in relation to the displacement positions. The pattern is compared to an empirically established range of pattern values. Once a malfunction is determined, the invention responds in a preselected manner.

13 Claims, 5 Drawing Sheets

CURRENT
3.00
2.00
1.00
0.00
-1.00
-2.00
0.00
20.00
40.00
60.00
80.00
POSITION
J1-23
J1-20
J1-9
J1-1
J1
12
13
14

J1-1 THRU J1-9 DIVIDED BY J1-20 THRU J1-23
1.00
0.80
0.60
0.40
0.00
0
50
100
150
200
250
300
POSITION
17
17
17
18

STATOR CURRENT BASED MALFUNCTION DETECTING SYSTEM IN A VARIABLE FLOW DELIVERY PUMP

BACKGROUND OF THE INVENTION

The present invention detects malfunctions in a variable flow delivery pump. In the case of a metering pump, normal operation is necessary to maintain the accurate output volume. It is also important to detect malfunctions so that damages to the pump system are prevented. For example, the pumps described in Milton Roy, Instruction Manuals for maxRoy B (118.7) and HPD Milroyal B, C and D (60.3) have symptoms of malfunctions. The possible trouble-shooting procedures for these malfunctions are described. However, when malfunctions occur, an operator should be systematically notified of the malfunctions or the pump system should react to correct the malfunctions.

Performance can be monitored by pressure, torque, or flow rate. A number of patents address monitoring a piston pump to reduce substantially pulsation in its output. For example, U.S. Pat. No. 4,225,290 and U.S. Pat. No. 4,180,375 disclose a circuit to initiate an alarm for the pump shutdown in response to the abnormal pressure or motor over-torque fault conditions. The protection is provided by comparing sampled pressure, current, or torque values against corresponding preset absolute values. If a sampled value exceeds the predetermined value, the system may stop itself to prevent damage to the pump. However, with a variable speed motor, the detection of malfunctions using a predetermined absolute value is difficult because externally sampled values are dependent upon motor speeds or flow rates. In addition, since the prior art requires an expensive external monitoring device, there has been a need for an inexpensive monitoring system for variable flow delivery pumps.

The current invention is to detect conditions which cause disturbances to the inherently high accuracy (better than ±0.5%) in the metering pump. These conditions include wear, hydraulic, or external system malfunctions, or component damage. Without these conditions, the metering pump can maintain high accuracy in constant volume without adjusting operational parameters.

The current invention monitors the pump performance without comparing the sampled values to a predetermined absolute value. Force exerted on a displacement part in the pump and the displacement positions are measured in the current invention. According to a predetermined mathematical formula, the pattern of force and positional signals are analyzed to detect malfunctions.

OBJECTS OF THE INVENTION

It is an object of this invention to provide a displacement metering pump system that is capable of detecting conditions that affect the inherent accuracy in the metering pump.

It is a further object of this invention to provide information on a type of malfunction so that the pump system can appropriately respond in a preselected manner.

It is another object of this invention to detect adverse conditions without an external device to measure the pump performance.

It is yet another object of this invention to determine the adverse conditions without comparing sampled values to predetermined absolute values. The determination is also independent of motor speeds or flow rates.

SUMMARY OF THE INVENTION

According to the current invention, a performance monitor of a displacement pump comprises means responsive to positions of a displacement part of the pump for producing positional trigger signals, means responsive to the positional trigger signals for measuring force exerted on the displacement part at different positions, means responsive to the force and positional trigger signals for determining a malfunction in the pump by calculating a force-position pattern value indicating a performance status of the pump and for generating a malfunction signal, and means responsive to the malfunction signal for responding in a selected manner.

In another embodiment, the apparatus monitors the performance of a pump system with a piston driven by a variable speed motor. The performance monitor comprises a signal generator responsive to piston positions to produce a plurality of positional trigger signals, means responsive to the positional trigger signals to measure motor current signals, computer means having a means responsive to the motor current signals and the positional trigger signals to calculate a value indicating a performance status of the pump which defines a motor current pattern value, means for generating a malfunction signal based upon the motor current pattern value for malfunctions in the pump system and control means responsive to the malfunction signal to control the pump system in a preselected manner.

Further in accordance with the invention, a method of monitoring the performance of a displacement pump includes generating a plurality of positional trigger signals to mark displacement positions over the cycle of pump operation, and measuring force exerted on a displacement part in the pump in response to the trigger signals.

DESCRIPTION OF THE PREFERRED EMBODIMENT

A performance monitor with the preferred embodiment of the invention will be discussed with reference to FIGS. 1 through 4. The invention is described generally as a performance monitoring system, however, it should be recognized by those of ordinary skill in the relevant art that there are numerous variations of force-position pattern analysis. Moreover, the description given herein is for exemplary purposes only and is not intended in any way to limit the scope of the invention. All questions regarding the scope of the invention may be resolved by referring to the appended claims.

Figure 1:
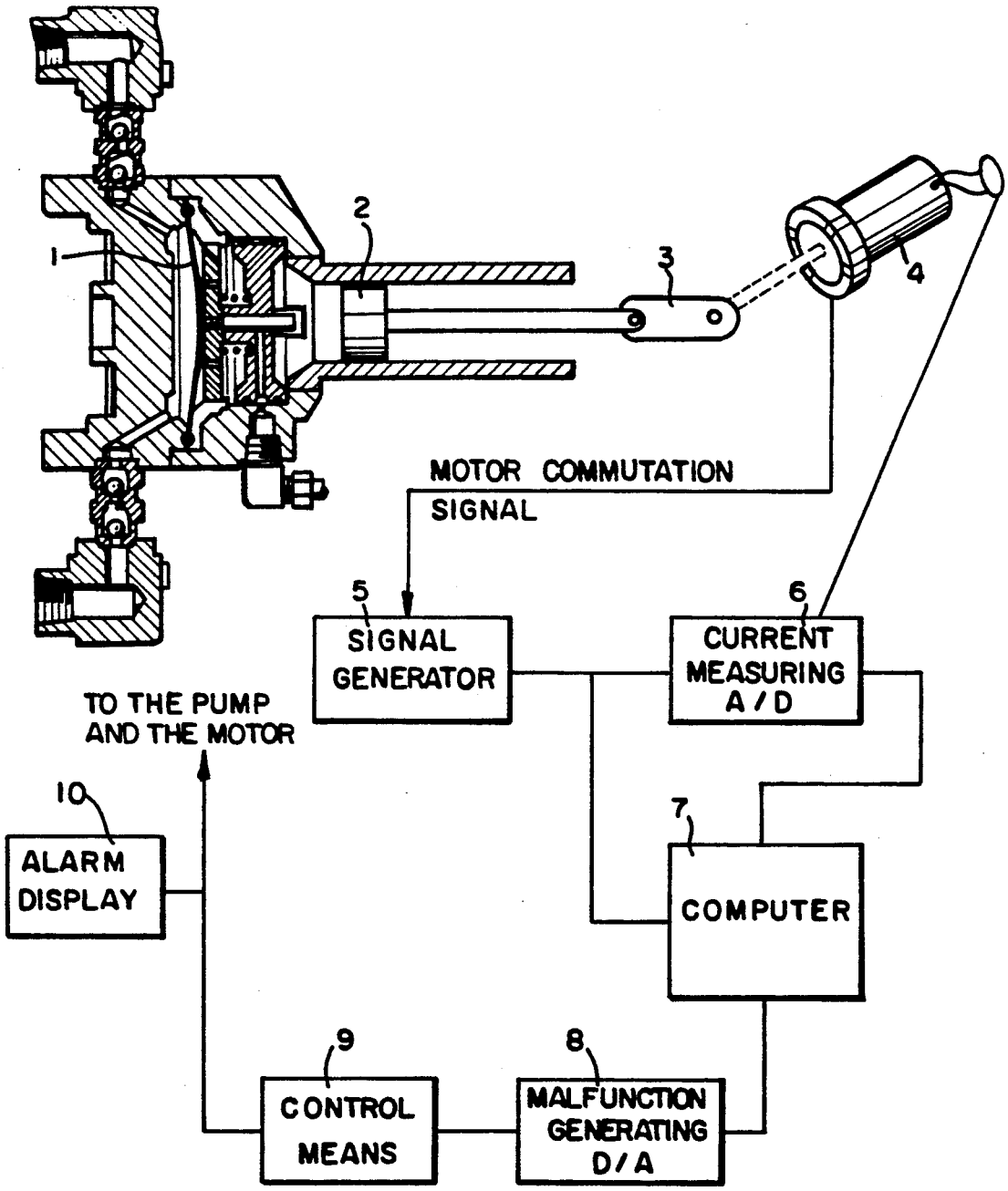
FIG. 1 is a diagram of the metering pump system wherein the system performance is monitored by a computer with a signal generator and a motor current measuring device.

Referring to FIG. 1, the mechanical part of the metering pump system is shown in the upper part of the diagram. A diaphragm is driven by a piston 2 which reciprocates by means of the eccentric 3 which is driven by a motor 4. Based upon the motor commutation signal, the signal generator 5 generates positional trigger signals which trigger the measurements of the motor current signals by the current measuring device 6. The signal generator 5 generates trigger signals in response to the motor commutation signal. Alternatively, it is a constant frequency, free running, signal generator. The frequency of the positional trigger signals may differ for each metering pump, but once it is established, the same frequency is used during the course of operation. In preferred embodiments, a range of 30–60 points per cycle is used. Upon the onset of a positional trigger signal, the current measuring device 6 measures the amount of the motor current drawn by the motor 4. The analog motor current signal is converted to a digitized value before being fed into the computer 7.

The computer 7 calculates a force-position pattern value based upon the motor current signals and positional trigger signals. The force-position pattern value signifies operational conditions of the metering pump. Upon detection of malfunction, the computer 7 acts through malfunction generating D/A convertor 8 to send a malfunction signal to the control means 9. The control means 9 takes an appropriate preselected action based upon the malfunction signal. For example, if it is diaphragm overextension, the control means 9 shuts off the motor so that further damage can be prevented. On the other hand, if the malfunction is minor, such as temporary cavitations, the control means 9 simply turns on a warning lamp or displays a message on the alarm display 10.

Figure 1A:
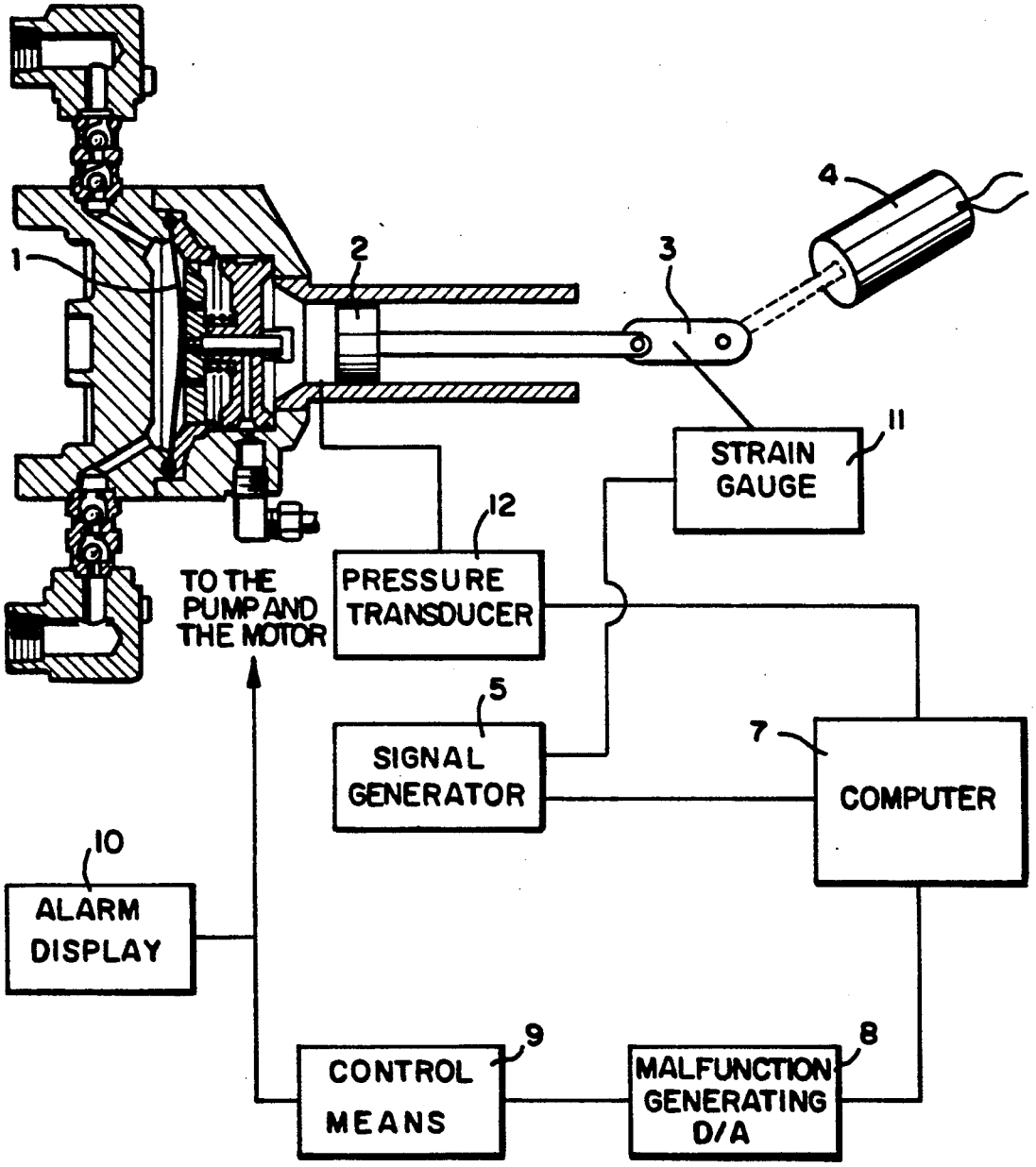
FIG. 1A illustrates another embodiment of the current invention with a pressure transducer to sense force exerted on the piston and a strain gauge to measure a displacement position.

Referring to FIG. 1A, this preferred embodiment is similar to FIG. 1 in that a diaphragm is driven by a piston 2 which reciprocates by means of the eccentric 3, which is driven by a motor 4. However, the strain gauge 11 monitors the piston position, and the pressure transducer 12 keeps track of force exerted by the piston 2. The output of the strain gauge is fed into the signal generator 5 for producing positional signals. The outputs of the pressure transducer 12 and signal generator 5 are fed into the computer 7. The computer 7 calculates a force-position pattern value based upon the pressure transducer signals and positional trigger signals. The force-position pattern value signifies operational conditions of the metering pump. Upon detection of malfunction, the computer 7 acts through malfunction generating D/A convertor 8 to send a malfunction signal to the control means 9. The control means 9 takes an appropriate preselected action based upon the malfunction signal as described above. If the nature of malfunction is minor, the control means 9 sends a signal to the alarm display unit 10 to warn the operator without affecting the pump operation.

Figure 1B:
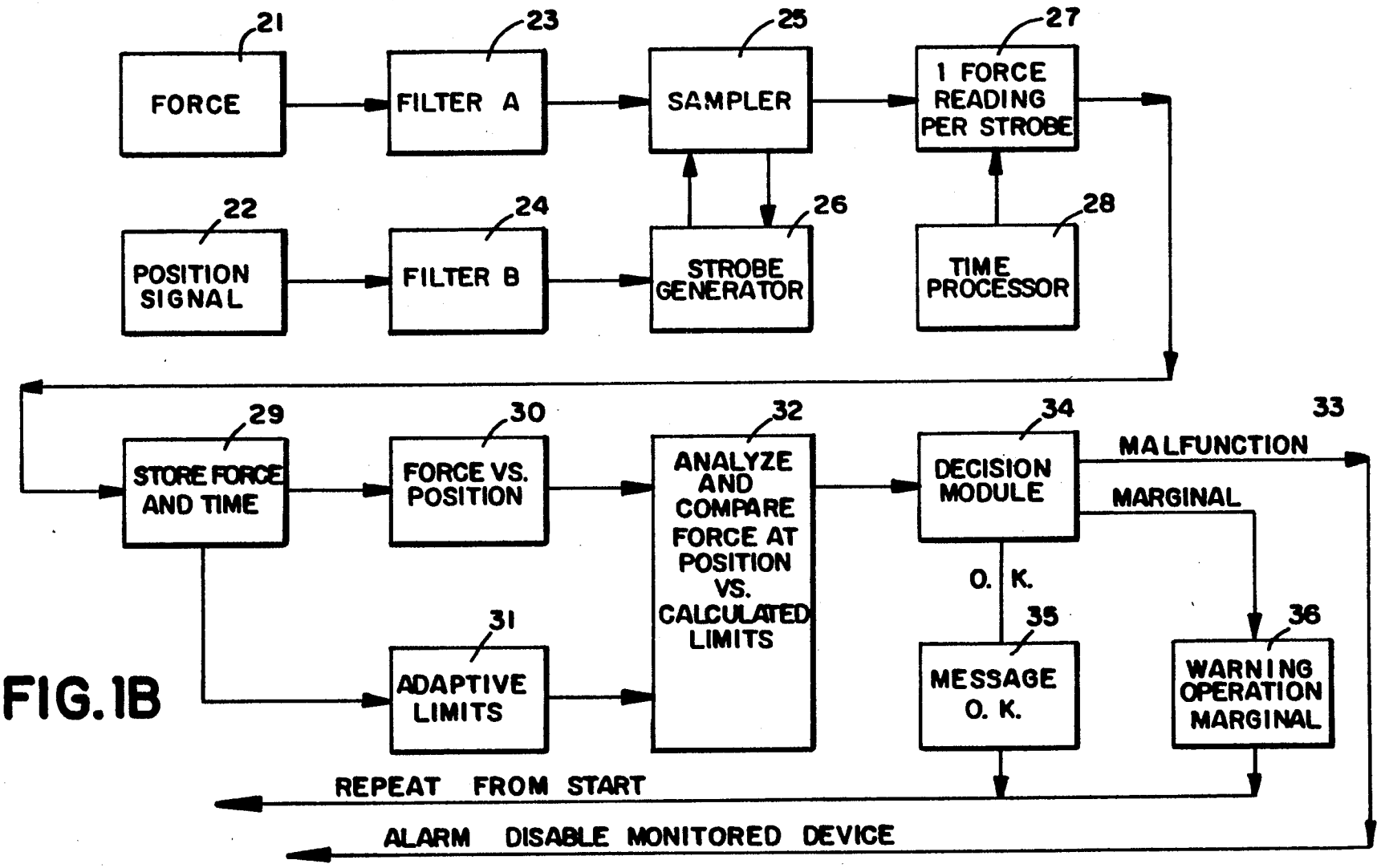
FIG. 1B is a block diagram showing how software running on the computer 7 in FIG. 1 on FIG. 1A works.

FIG. 1B illustrates details of software which run on the computer 7 in FIGS. 1 and 1A. The force input signal 21, such as the pressure transducer signal or motor current signal is filtered by the filter module 23 to eliminate undesirable extraneous noise of the signal. The position signal 22 such as the strain gauge signal is also filtered by another filter module 24. The output from the filter module 23 is fed into the sampler 25 module while the output from the second filter module 24 is fed into the strobe generating module 26. Thus, the sampler module 25 is controlled by the strobe generator 26. One force reading takes place for each strobe signal generated by the strobe generator module 26. The sampler module 25 also gives a feed back signal to the strobe module 26. This feedback signal is used to determine the directional change in the sampled signal for a beginning or an end of the strobe. The sampled force signal is time stamped by the time processor clock 28 in the time stamp module 27 before being stored in the sampled force-time memory storage 29. From the stored data in the memory storage 29, the force-position pattern is calculated by the force-position module 30. To ascertain an accurate force-position pattern value, the force-position module 30 finds the minimal force value at the fully extended piston position. The detail of the algorithm will be explained below. From the output from the force-position module 30 and the data in the memory storage 29 the adaptive value force-position pattern value limits are calculated by the device-specific adaptive value limit module 31. The adaptive value limit is calculated from an empirically established value limit and maximal force value as described more fully below. The force-position pattern value and adaptive value limits are fed into the analysis module 32, which compares these two values. The output of the analysis module 32 is further processed by the device-specific decision module 34 to determine whether the monitored system is experiencing malfunction. The outputs from the device-specific analysis module include, a normal operation 35, warning condition 36, and malfunction 33. The outputs 35 and 36 indicate that a cycle is acceptable to continue while the output 33 indicates a condition seriously affecting pump operation.

The above-described software can be implemented using a general purpose computer such as a PC or a dedicated processor. Filter modules 23 and 24 can be either software or hardware. The adaptive value limits module 31 and the decision module 34 are device-specific and modified versions of these modules and are necessary for different models of pump devices. This is because a different model pump has its own characteristics for normal operation. However, the rest of the software does not have to be modified for a different device.

Figure 2:
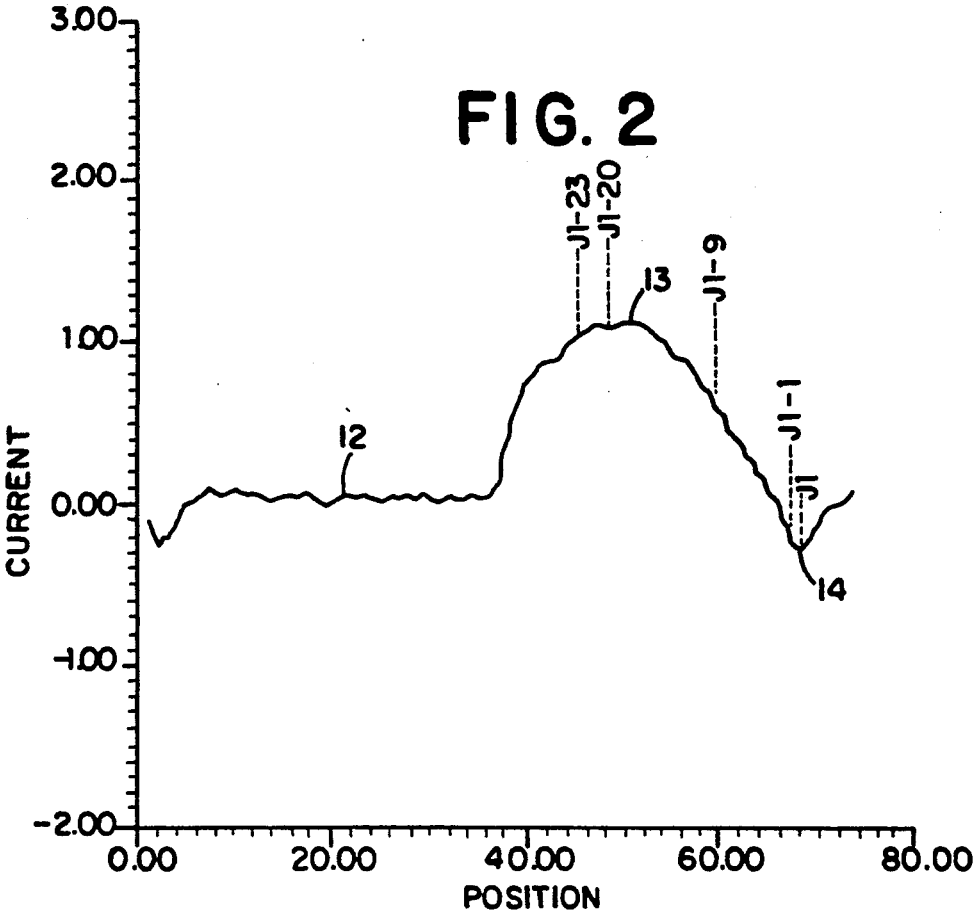
FIG. 2 shows sampled values that are used in calculating the motor current pattern value.

FIG. 2 illustrates a force-position pattern. Although, the force can be measured in different units, for example, the motor current described in FIG. 1, the concept of force vs. position analysis for monitoring malfunction is the same for different embodiments. The lowest motor current is designated as $J_1$, and each sampled value prior to $J_1$ is designated as $J_{1-1}$ through $J_{1-23}$. For example, the motor current pattern value can be calculated by first determining the lowest motor current 14 and highest motor current signal 13 in a cycle, then summing the 9 sampled values prior to the lowest motor current value 14. The summed value j in the equation below is divided by the summation K of 4 values (last 20th to 23rd sampled values from the lowest motor current value 14).

$$FPPV = \frac{\sum_{i=1-1}^{1-9} j_i}{\sum_{l=1-20}^{1-23} K_l}$$

where FPPV is a force-position pattern value. This alogrithm is one example used in the force-position module 30 in FIG. 1B. Unlike predetermined absolute high or low motor current values, the force-position pattern value is independent of motor speeds or flow rates and does not require a base line value. This is because the force-position pattern value is calculated by many sampled values, rather than a single instantaneous value. Thus, a pattern of these values reflects an operational status of the pump system.

Figure 3A:
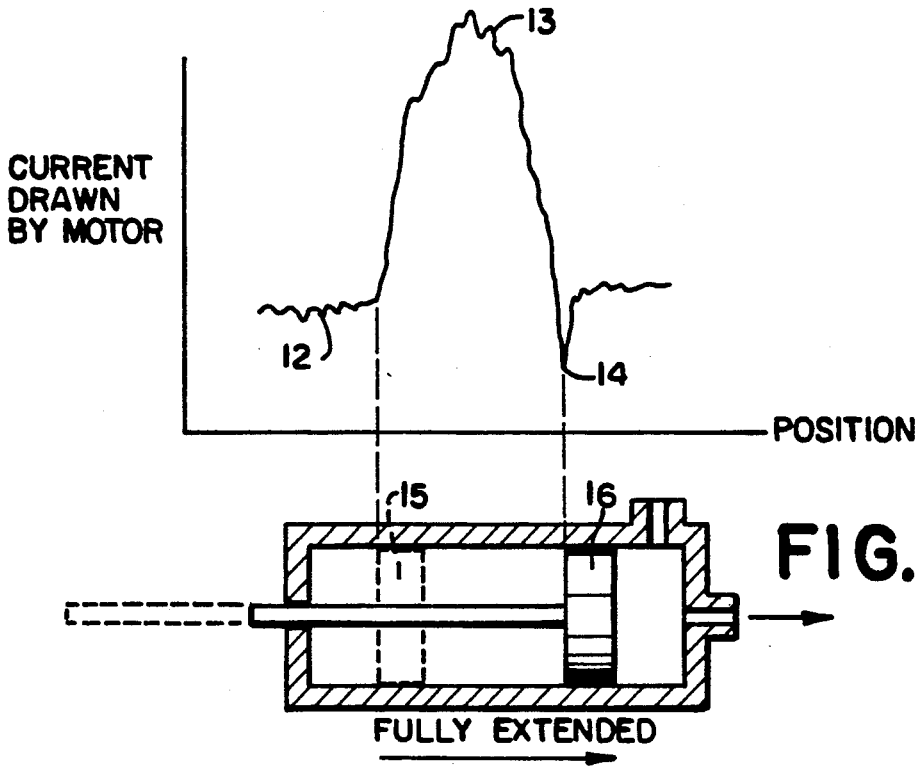
FIGS. 3A and 3B show the motor current as a function of time which relates to the piston position.
Figure 3B:
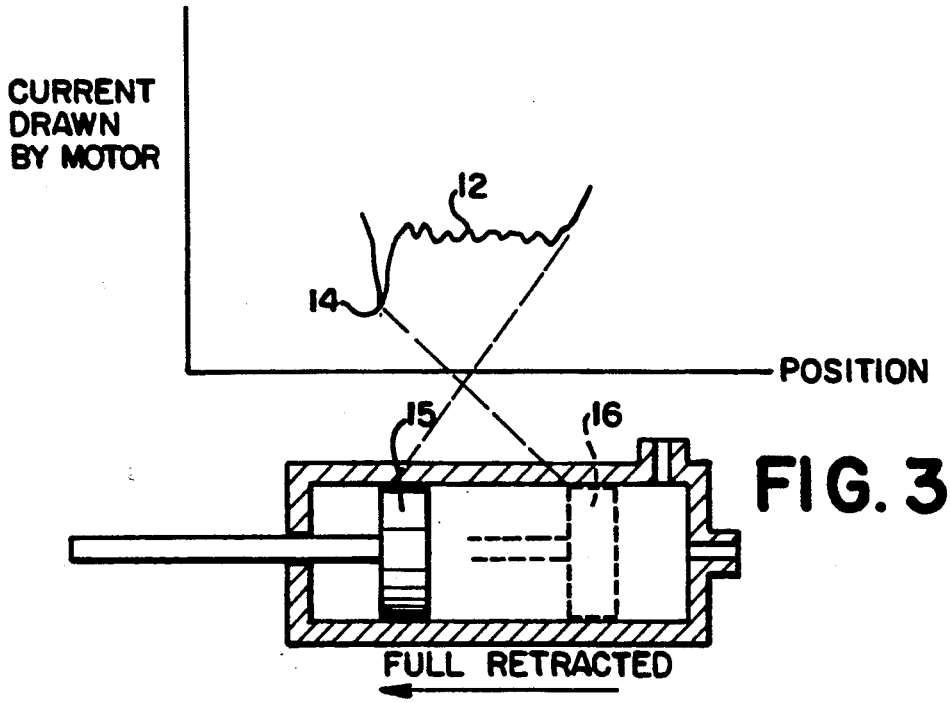

Referring to FIG. 3A, the force-position signals are plotted as a function of piston positional/temporal trigger signals. The pressuring phase 12 through 14 in FIG. 3A represents the motor current signals from the fully retracted position 15 to the fully extended position 16. At the lowest motor current 14, the piston 16 is fully extended and exerts the least amount of the pressure to the pump system, thereby drawing the least amount of motor current. The retraction phase 14 through 12 in FIG. 3B indicates a period where the piston moves from the fully extended position 16 to the fully retracted position 15 in FIG. 3B.

Figure 4:
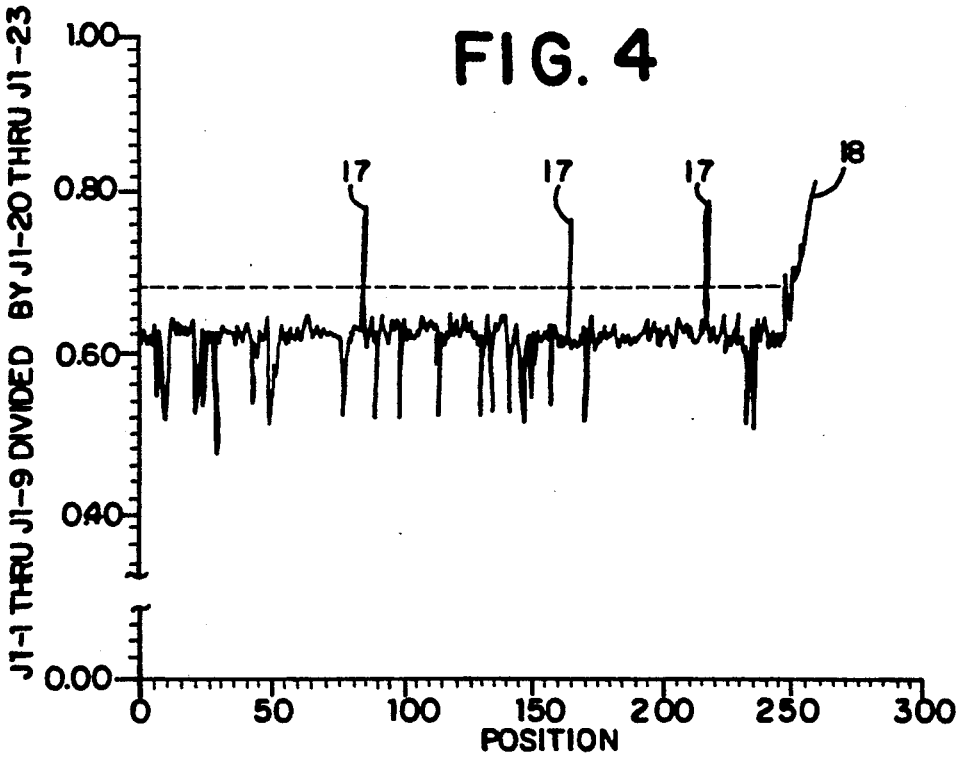
FIG. 4 shows the graphical representation of the motor current pattern values in relation to the empirically established value limit.

The force-position pattern value can detect a number of malfunctions. To detect malfunctions, a range of the force-position pattern values must be empirically established for a normal operation. A comparison between the force-position pattern value and the empirically established range can resolve the nature of adverse conditions. Such an empirically established range of force-position pattern values defines the adaptive value limit. For example, the adaptive value limit for a 1 inch piston in a 106 mm diaphragm pump, is defined as the max current raised to the −0.239004th power multiplied by 0.70607. The product is the adaptive value limit while the constants are empirically established. The adverse conditions include 1) diaphragm overextension, 2) cavitation, 3) malfunctioning pump valves, 4) mis-set system valves, 5) inadequate discharge pressure and 6) pump hydraulic system malfunction. Referring to FIG. 4, the force-position pattern values are plotted as a function of cycles. Four separate malfunctions occurred during this operation. Three of them, indicated at 17, are fault conditions, while 18 is caused by a diaphragm overextension.

In another preferred embodiment, the present invention is applied to a gear type positive displacement pump in which the motion of a single pair of teeth into and out of mesh substitutes the single stroke of a piston. Although, the numerical values for the value limits are different, the same concept for the algorithm is applicable. Yet in another preferred embodiment, a vane type positive displacement pump, the force-position relationship of a single vane as it moves from suction to discharge is monitored by the same concept. Again, the value limits are different for this embodiment.

The present invention may be embodied in other specific forms without departing from the spirit or essential attributes thereof. Accordingly, reference should be made to the appended claims, rather then to the foregoing specification, as indicating the scope of the invention.

What is claimed is:

1. Apparatus for monitoring performance of a displacement pump, comprising:

(a) means responsive to positions of a displacement part of said pump for producing positional trigger signals;

(b) means responsive to said positional trigger signals for measuring force exerted on said displacement part at different positions;

(c) means responsive to said force and said positional trigger signals for calculating a force-position pattern value indicating a performance status of said pump to determine a malfunction in said pump, said force-position pattern value being independent of displament speeds or pump flow rates, said force-position pattern value being generated from a plurality of force measurements from step (b), said calculating means generating a malfunction signal based upon a comparison between said force-position pattern value and a range of empirically established adaptive value limits representing force-position pattern values during normal operations of pumps which have particular characteristics for such normal operations; and (d) means responsive to said malfunction signal for responding in a selected manner.

2. Apparatus according to claim 1 wherein said calculating means responsive to said force-position pattern generates a plurality of malfunction signals upon determination of a malfunction, each malfunction signal indicating a type of malfunction.

3. Apparatus according to claim 1 wherein said selected responses to said malfunction signal include at least any combination of a shutdown of said pump, visual or audible warnings and a suspension of said pump.

4. Apparatus for monitoring performance of a pump system having a piston reciprocated by a variable speed motor comprising:

a) a signal generator responsive to piston positions to produce repetitively a plurality of positional trigger signals;

b) means responsive to the positional trigger signals to measure motor current signals;

c) computer means having a means responsive to the motor current signals and the positional trigger signals to calculate a motor current pattern value indicating a performance status of said pump, said motor current pattern value being generated from a plurality of measured current signals from step (b);

d) a means for generating a malfunction signal based upon the motor current pattern value and adaptive value limits representing the motor current pattern value during normal operation of pumps which have particular characteristics for such normal operations; and e) control means responsive to the malfunction signal to control the pump system in a preselected manner.

5. Apparatus according to claim 4 wherein said pump system is a metering pump with a diaphragm.

6. Apparatus according to claim 4 wherein said motor current signals correspond to torque exerted by the motor, the torque being indicated by the pressure of the pump at the onset of each trigger signal.

7. Apparatus according to claim 4 wherein the response of the control means responsive to the malfunction signal includes at least any combination of a shutdown of the system, visual or audible warnings and a suspension of the pump system.

8. Apparatus according to claim 4 wherein said computer means responsive to the motor current signals and the positional trigger signals calculates the motor current pattern value, the motor current pattern value indicating a performance status of the pump system, the motor current pattern value being independent of motor speeds or pump flow rates.

9. Apparatus according to claim 8 wherein the computer means responsive to the motor current signals and the positional trigger signals determines malfunctions in the pump system, a range of the motor current pattern values during normal operations defining a value limit range, the motor current pattern value which being out of the empirically established value limit range defining the malfunctions.

10. A method for monitoring performance of a displacement pump comprising:

a) generating a plurality of positional trigger signals to mark displacement positions over a cycle of pump operation;

b) measuring force exerted on a displacement part in said pump in response to said trigger signals;

c) storing the force measurements;

d) determining a force-position pattern value from said force measurements and said trigger signals said force-position pattern value being generated from a plurality of force measurements from step (b);

e) determining malfunction based upon said force-position pattern value and an empirically established value limit range of said force-position pattern values, said empirically established value limit range being a range of index values indicating normal operations of said pump, the empirically established value limit range being independent of displacement speeds or flow rates;

f) based on step (e), producing a malfunction signal indicating a type of malfunction; and g) based on step (f) responding to said malfunction signal in a preselected manner.

11. Apparatus for monitoring performance of a pump system having a piston reciprocated by a variable speed motor comprising:

a) a signal generator responsive to piston positions to produce repetitively a plurality of positional trigger signals, said positional trigger signals being commutation signals of the motor indicating the positions of the motor rotor in quadrants;

b) means responsive to the positional trigger signals to measure motor current signals;

c) computer means having a means responsive to the motor current signals and the positional trigger signals to calculate a motor current pattern value indicating a performance status of said pump;

d) means for generating a malfunction signal based upon the motor current pattern value for malfunctions in the pump system; and f) control means responsive to the malfunction signal to control the pump system in a preselected manner.

12. Apparatus for monitoring performance of a pump system having a piston reciprocated by a variable speed motor comprising:

a) a signal generator responsive to piston positions to produce repetitively a plurality of positional trigger signals;

b) means responsive to the positional trigger signals to measure motor current signals;

c) computer means having a means responsive to the motor current signals and the positional trigger signals to calculate a motor current pattern value indicating a performance status of said pump, said computer means being responsive to the motor current signals and the positional trigger signals to calculate the motor current pattern value, the motor current pattern value indicating a performance status of the pump system, the motor current pattern value being independent of motor speeds or flow rates, said computer means being responsive to the motor current signals and the positional trigger signals to determine malfunctions in the pump system, said computer means having an empirically established value limit range defining a range of the motor current pattern values during normal operations;

d) means for generating a malfunction signal, based upon the motor current pattern value for malfunctions in the pump system, said means being responsive to the motor current signals to produce a plurality of malfunction signals when the motor current pattern value is out of said value limit range, each malfunction signal indicating a type of malfunction; and f) control means responsive to the malfunction signals to control the pump system in a preselected manner.

13. A method for monitoring performance of a displacement pump comprising:

a) generating a plurality of positional trigger signals to mark displacement positions over a cycle of pump operation;

b) measuring force exerted on a displacement part in said pump in response to said trigger signals;

c) storing the force measurements;

d) determining a force-position pattern value from said force measurements and said trigger signals;

e) determining malfunction based upon said force-position pattern value and an empirically established value limit range of said force-position pattern values, the determination of malfunctions being based upon a comparison between the empirically established value limit range and the force-position pattern value wherein malfunctions are determined independently of any absolute value or base line value;

f) based on step (e), producing a malfunction signal indicating a type of malfunction; and g) based on step (f) responding to said malfunction signal in a preselected manner.

* * * * *